US005970609A

United States Patent [19]

Shioda

[11] Patent Number: 5,970,609

[45] Date of Patent: Oct. 26, 1999

[54] METHOD OF MANUFACTURING WIRE HARNESS FOR AUTOMOBILE USE

[75] Inventor: Ryosuke Shioda, Nagoya, Japan

[73] Assignees: Harness System Technologies Research, Ltd., Nagoya; Sumitomo Wiring Systems, Ltd., Mie; Sumitomo Electric Industries, Ltd., Osaka, all of Japan

[21] Appl. No.: 09/025,804

[22] Filed: Feb. 19, 1998

[30] Foreign Application Priority Data

Feb. 26, 1997 [JP] Japan ..... 9-042430

[51] Int. Cl.[6] ..... H01R 43/04

[52] U.S. Cl. ..... 29/861; 29/861; 29/857; 29/753; 29/763; 29/33 M

[58] Field of Search ..... 29/861, 857, 749, 29/748, 753, 755, 762, 763, 33 M; 140/92.1

[56] References Cited

U.S. PATENT DOCUMENTS

| | | | |
|---|---|---|---|
| 4,552,260 | 11/1985 | Teagno et al. | 198/345 |
| 4,581,796 | 4/1986 | Fukuda et al. | 29/33 M |
| 5,052,449 | 10/1991 | Fukuda et al. | 149/93 R |
| 5,611,141 | 3/1997 | Takada et al. | 29/861 |

FOREIGN PATENT DOCUMENTS

| | | |
|---|---|---|
| 168141 | 1/1986 | European Pat. Off. . |
| 403115 | 12/1990 | European Pat. Off. . |
| 427668 | 5/1991 | European Pat. Off. . |
| 1-313869 | 12/1989 | Japan . |
| 9-283254 | 10/1997 | Japan . |

*Primary Examiner*—Lee Young
*Assistant Examiner*—Minh Trinh
*Attorney, Agent, or Firm*—Oliff & Berridge, PLC

[57] ABSTRACT

A method of effectively manufacturing various types of wire harnesses of complicated wiring structure in which a predetermined number of connectors necessary for a unit wire harness are arranged on a movable pallet. The pallet is then moved so that crimp-style terminal of one of the connectors can come to a crimp connecting position of a rotatable crimp connecting press. An end of an electric wire is fed to the crimp-style terminal at the crimp connecting position. The end of the electric wire is then connected to the terminal by the rotatable crimp connecting press. Then, the pallet is moved again, and the other end of the electric wire is connected to a crimp-style terminal of a predetermined connector by crimp connection. The series of motions are repeated until all terminals necessary for the unit wire harness are connected to the electric wires by crimp connection. According to this method, a rotatable crimp connecting press has a plurality of different crimp connecting blades.

8 Claims, 7 Drawing Sheets

METHOD OF MANUFACTURING WIRE HARNESS FOR AUTOMOBILE USE

BACKGROUND OF THE INVENTION

1. Field of the Invention

The present invention relates to a method of manufacturing a wire harness for automobile use.

2. Discussion of Related Art

An example of the wire harness for automobile use is shown in FIG. 6, which is composed in such a manner that electric wires "a" are arranged in parallel with each other, connectors C are connected to appropriate portions of the electric wires in the longitudinal and the transverse direction, and the connectors C are covered with covers T if necessary.

From the viewpoint of enhancing the working efficiency, the electric wires "a" are frequently connected to the connectors C by means of crimp-style connection, also referred to herein as a crimp connection. As shown in FIG. 7, this crimp-style connection is conducted in the following manner. In the connector, there is provided a crimp-style terminal 41 having a groove 42, the width of which is somewhat smaller than the outer diameter of the electric wire "a". The electric wire "a" is fed into the groove 42 and pushed down by a crimp connecting blade not shown in the drawing, so that the electric wire "a" can be press-fitted into the groove 42. In the case of an electric wire "a" composed of a bundle of conductors 44 and covering material 43 which covers the bundle of conductors 44, the covering material 43 is torn by the wall of the groove 42 when the electric wire "a" is press-fitted into the groove, so that the bundle of conductors 44, which have been exposed, come into contact with the terminal 41 and electrically communicate with the terminal 41. At the same time, the electric wire "a" is fixed into the groove 42 by the action of spring-back of the terminal 41.

In this connection, an intensity of the spring-back action of the terminal 41 and a pushing distance of the electric wire "a" which has been pushed down are relatively related to each other. When the pushing distance of the electric wire "a" is increased, the intensity of the spring-back action of the terminal 41 is increased. However, when the pushing distance of the electric wire "a" is excessively increased, the terminal 41 is plastically deformed, and the intensity of the spring-back action is decreased or further decreased to zero. In the above case, the crimp connection becomes unstable, and the electric wire "a" is disconnected from the terminal 41 even if a low intensity of force is given to the crimp connecting section from the outside or even if the crimp connecting section is somewhat oscillated.

In the same manner, when the pushing distance of the electric wire "a" is too small, the intensity of the spring-back action becomes too low. Also, the crimp connection becomes unstable in this case.

In order to connect the electric wire "a" to the groove 42 with pressure in a stable state by the action of spring-back so that the electric wire "a" can be positively communicated with the terminal 41, it is necessary that the electric wire "a" is pushed into the groove 42 by an appropriate distance. When this crimp connection, in which the electric wire "a" is pushed into the groove 42 by an appropriate distance, is manually conducted by a worker, the pushing distance of the crimp connecting blade fluctuates, that is, when a different worker conducts the crimp connection by pushing the electric wire "a" into the groove 42, the pushing distance fluctuates.

Usually, a plurality of electric wires "a" are connected to one connector C as shown in FIG. 6. When the plurality of electric wires "a" are manually connected by a worker one by one, the pushing distance of the electric wire "a" for each terminal fluctuates even if the same worker conducts this connection.

When the number of electric circuits (the number of electric wires "a") increases, the number of crimp connections also increases. In accordance with the increase in the number of crimp connections, there is a possibility of the occurrence of erroneous wiring. In order to solve the above problems, this crimp connection has been automatized recently.

When an automatic crimp connecting machine is used in the manufacture of the wire harness, the aforementioned fluctuation of connection can be avoided and further the connecting speed can be increased. However, the following problems may be encountered. FIG. 8 shows an example of connections made by connectors and terminals, which are arranged as follows. The connector includes five connectors $C_1$, $C_2$, $C_3$, $C_4$ and $C_5$. Connector $C_1$, has four terminals of $T_{11}$ to $T_{14}$, connector $C_2$ has four terminals of $T_{21}$ to $T_{24}$, and connector $C_3$ has four terminals of $T_{31}$ to $T_{34}$. Connector $C_4$ has three terminals of $T_{41}$ to $T_{43}$, and connector $C_5$ has three terminals of $T_{51}$ to $T_{53}$. Electric wire "a" includes four electric wires of $a_1$, $a_2$, $a_3$ and $a_4$, which are complicatedly connected to the connectors as shown in the drawing. In order to manufacture the above wire harness, the structure of the manufacturing apparatus becomes complicated and the size of the apparatus is increased. As a result, the manufacturing cost is raised. Therefore, it is impossible to apply the automatic connecting machine to a case in which a large number of types of products are produced, wherein a quantity of each type of product is small.

In an automobile factory in which the number of electronic parts to be incorporated into automobiles is increased day after day, it is an urgent necessity to manufacture various types of wire harness of complicated wiring effectively.

SUMMARY OF THE INVENTION

It is an object of the present invention to effectively manufacture various types of wire harness, the wiring structure of which is complicated.

DETAILED DESCRIPTION OF PREFERRED EMBODIMENTS

In order to solve the above problems, the present invention is to provide a method of manufacturing a wire harness for automobile use comprising the steps of: arranging a predetermined number of connectors necessary for a unit wire harness on a movable pallet; moving the pallet so that a crimp-style terminal (also referred to herein as a crimp terminal) of one of the connectors can come to a crimp connecting position of a crimp connecting press; feeding an end of an electric wire to the crimp-style-terminal that has come to the crimp connecting position; crimping one end of the electric wire by the crimp connecting press; moving the pallet again; crimping the other end of the electric wire so as to be connected to a crimp-style terminal of a predetermined connector; and repeating a series of motions until all connectors necessary for the unit wire harness are connected to the electric wires by means of crimp connection.

According to the above method, it is possible to conduct the crimp connection of wire harness with a crimp connecting press, the motion of which is simple, and it is also possible to reduce the size of the entire apparatus and the manufacturing cost can be reduced. Accordingly, it is possible to manufacture various types of wire harness of complicated wiring structure.

At this time, the movement of the pallet can be numerically controlled. Due to the foregoing, the terminal can be quickly positioned at a crimp connecting position with high accuracy.

The movement of a crimp connecting blade of the crimp connecting press can also be numerically controlled. Due to the foregoing, the crimp connecting blade can be quickly positioned at a position of the most appropriate distance with high accuracy.

The crimp connecting press has a function of automatically replacing the crimp connecting blade. Due to the foregoing, much labor is not required for replacing the crimp connecting blade, and further the replacing work can be executed quickly.

Figure 1:
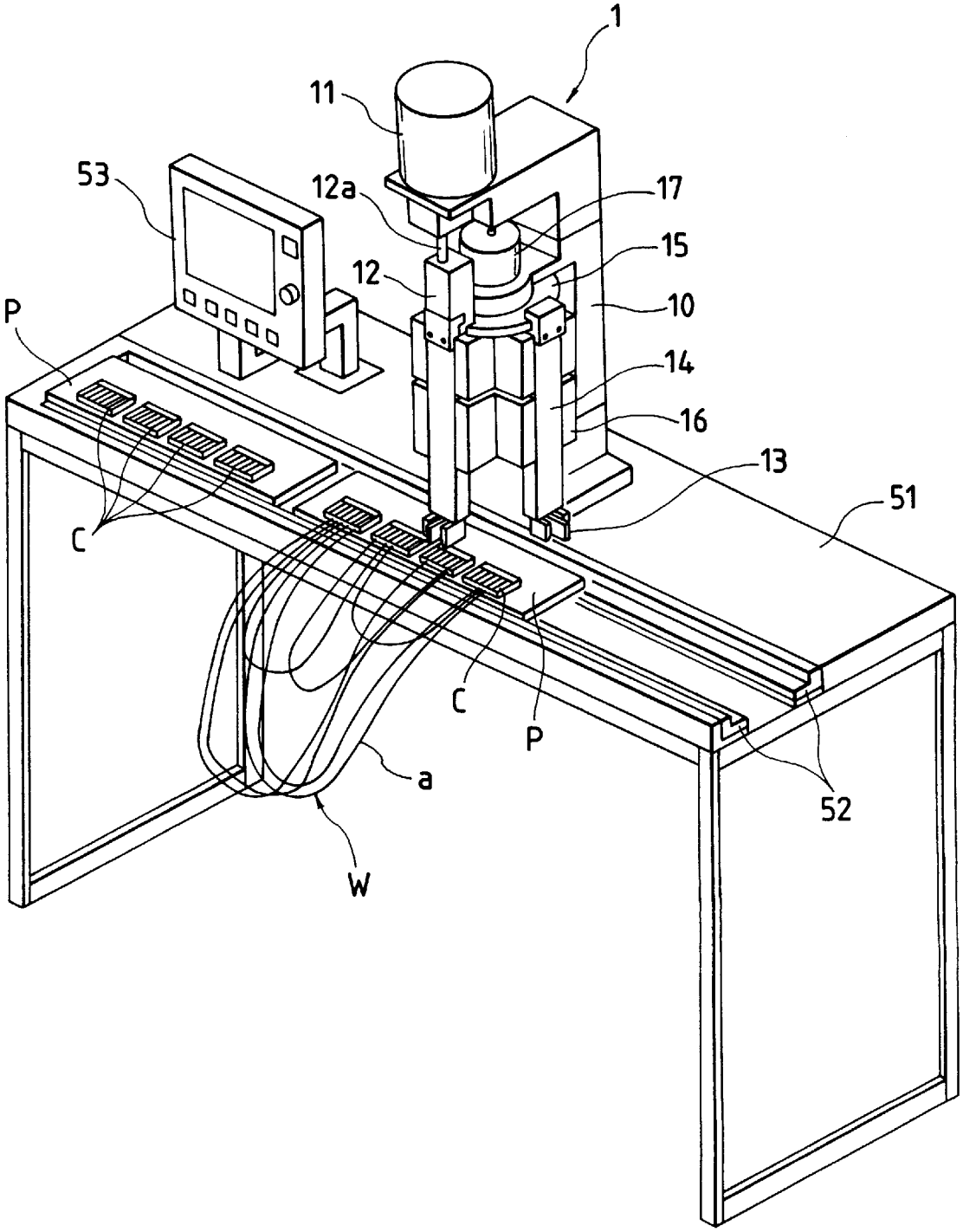
FIG. 1 is an overall perspective view showing an embodiment of the present invention.

Referring to FIGS. 1 to 5, an embodiment of the present invention will be explained below. In the wire harness manufacturing method of this embodiment, the apparatus shown in FIG. 1 is used. In the drawing, reference numeral 51 is a frame in which the electric wires "a" are connected to connectors by means of crimp connection. There are provided rails 52 on an upper surface of the frame 51 in the longitudinal direction, wherein these rails are arranged on the worker's side with respect to the width direction of the frame 51. On the rails 52, there are provided pallets P which slide on the rails 52. One or more connectors C are put on each pallet P. Crimp connecting work is conducted on this pallet P.

There is provided a crimp connecting press 1 on an upper surface of the frame 51 at the center in the longitudinal direction, wherein this crimp connecting press 1 is arranged at the rear with respect to the width direction of the frame 51. Also, there is provided a control panel 53 for operating the crimp connecting press 1 and the drive mechanism of the pallet P.

Figure 2:
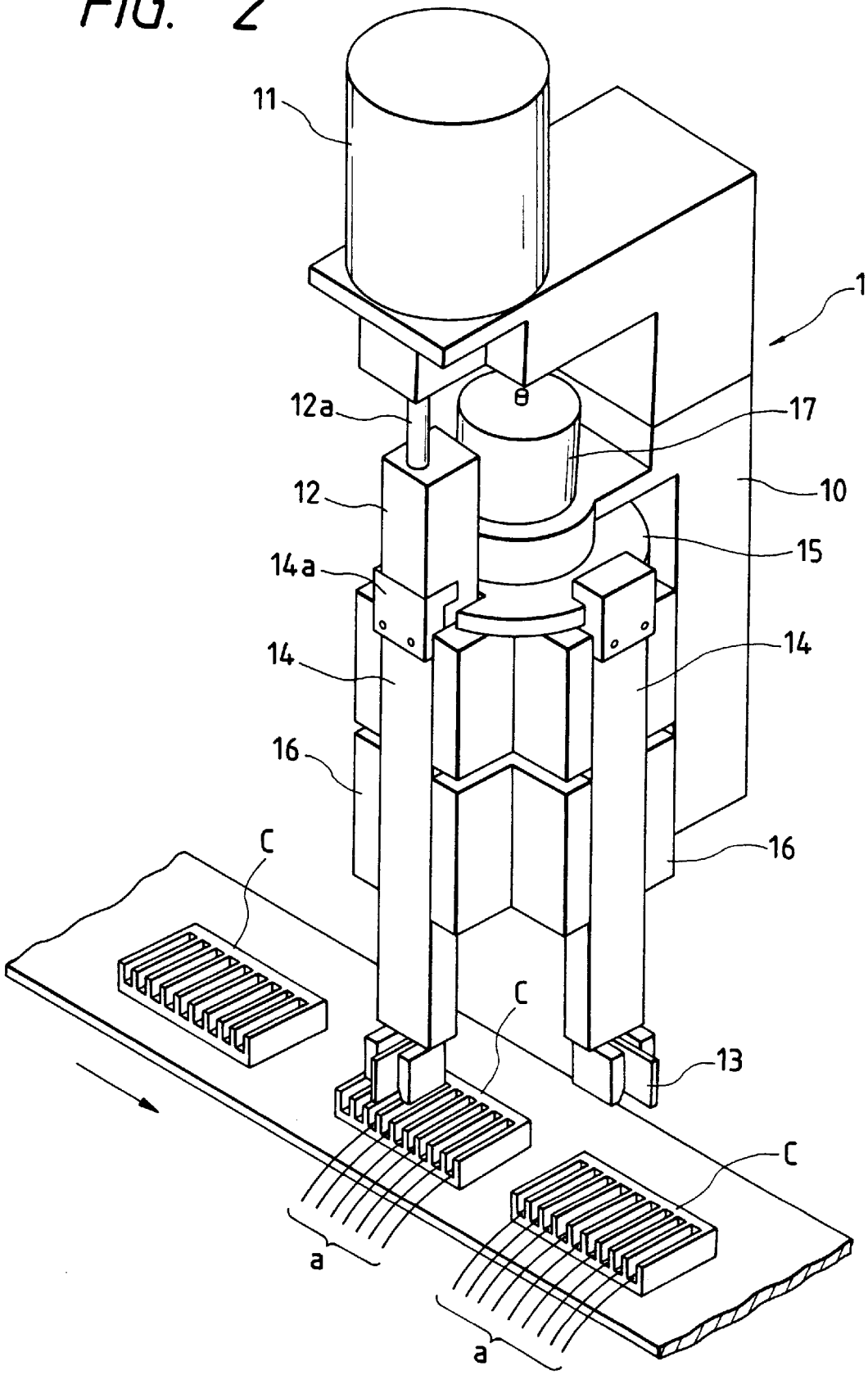
FIG. 2 is a perspective view of the crimp connecting press shown in FIG. 1.
Figure 3:
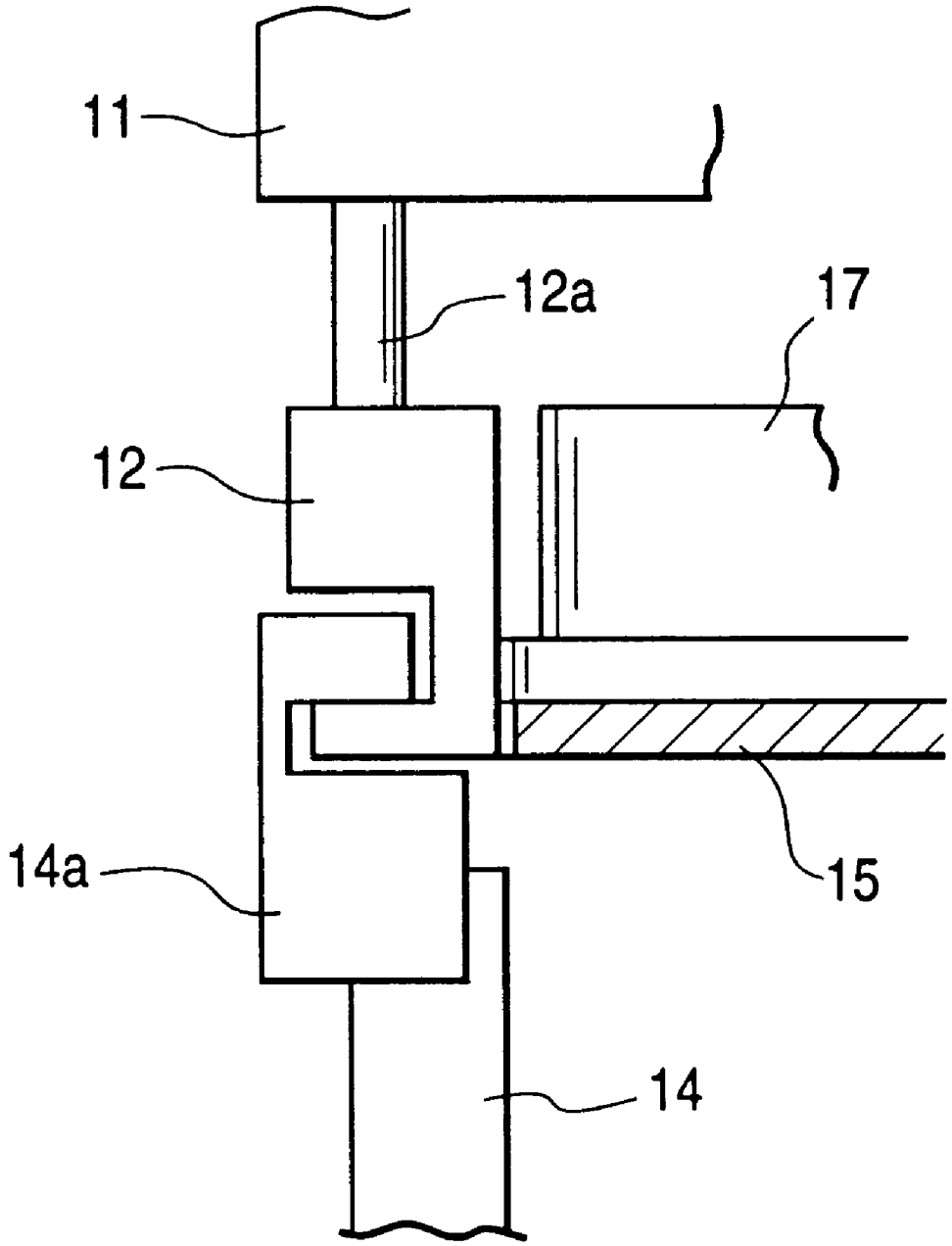
FIG. 3 is a cutaway front view of the primary portion of FIG. 2.
Figure 4A:
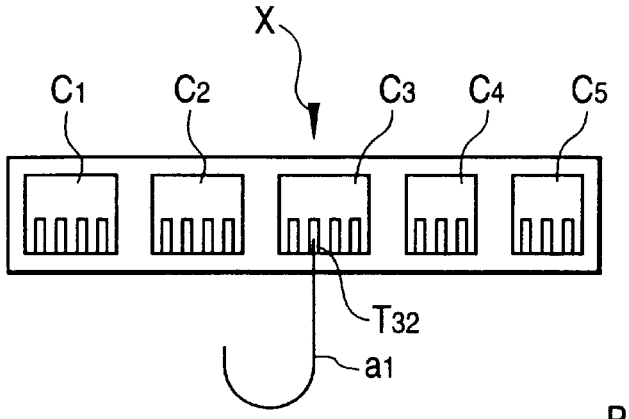
FIGS. 4A–4D are plan views showing a model of the process of manufacturing the wire harness of the embodiment.
Figure 4B:
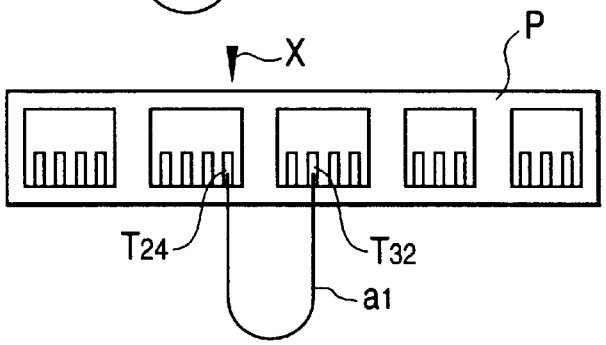
Figure 4C:
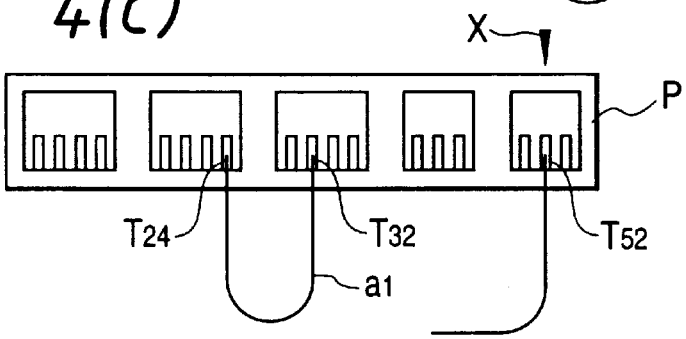
Figure 4D:
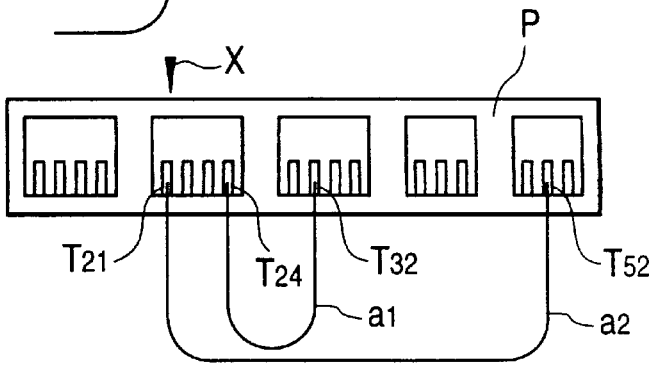
Figure 5A:
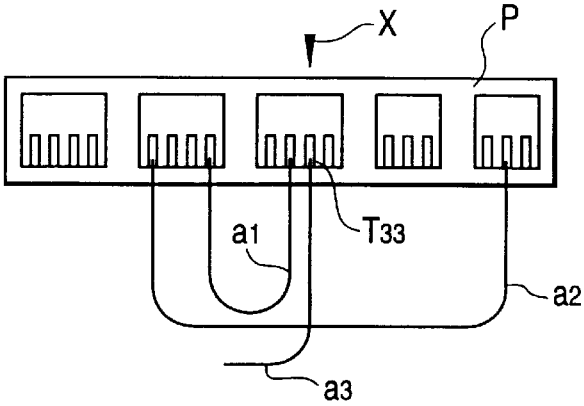
FIGS. 5A–5D are plan views showing a model of the successive process of FIG. 4.
Figure 5B:
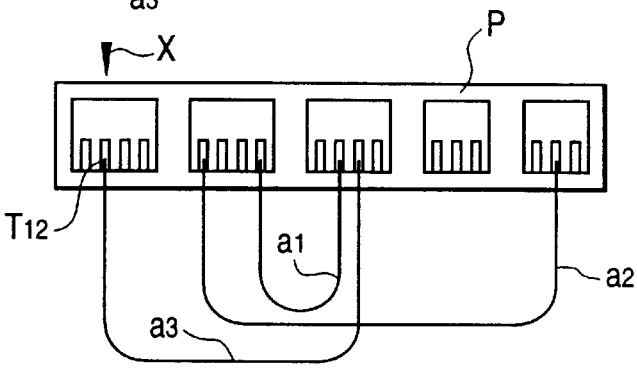
Figure 5C:
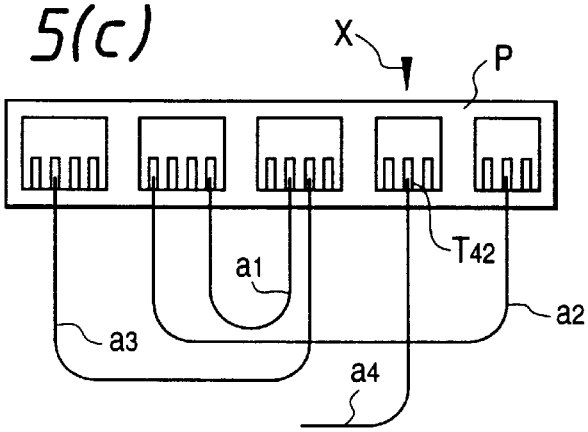
Figure 5D:
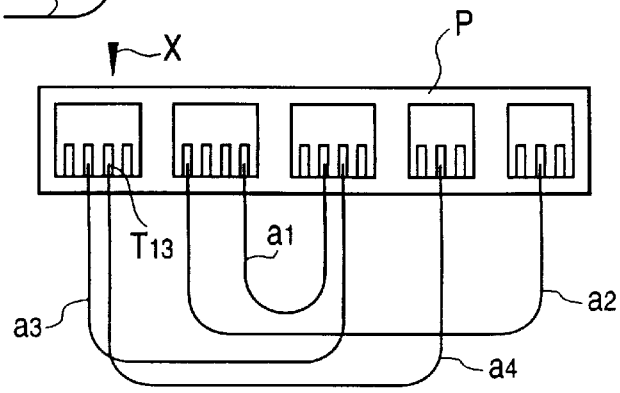
Figure 6:
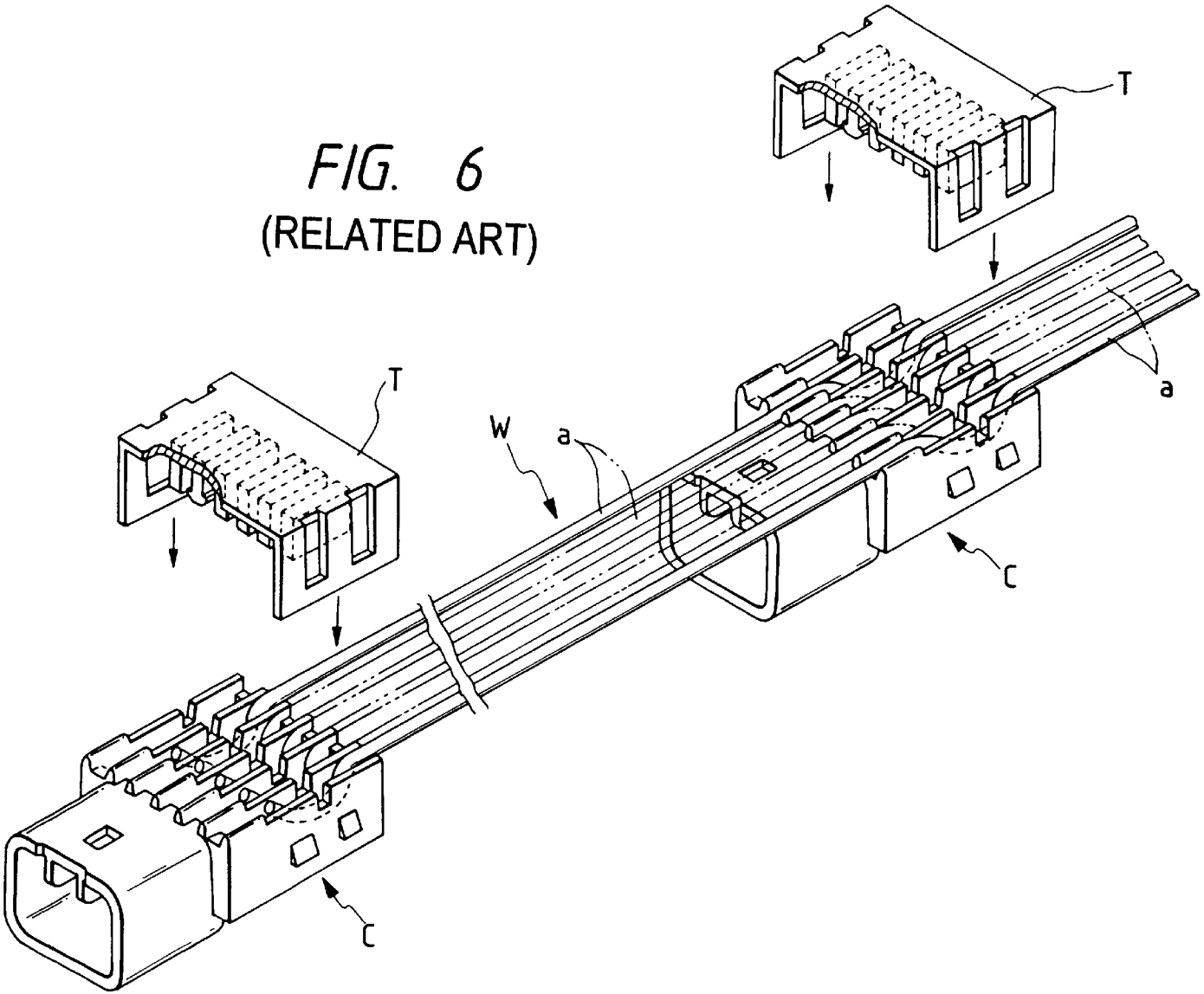
FIG. 6 (RELATED ART)
FIG. 6 is a perspective view showing an example of the wire harness.
Figure 7:
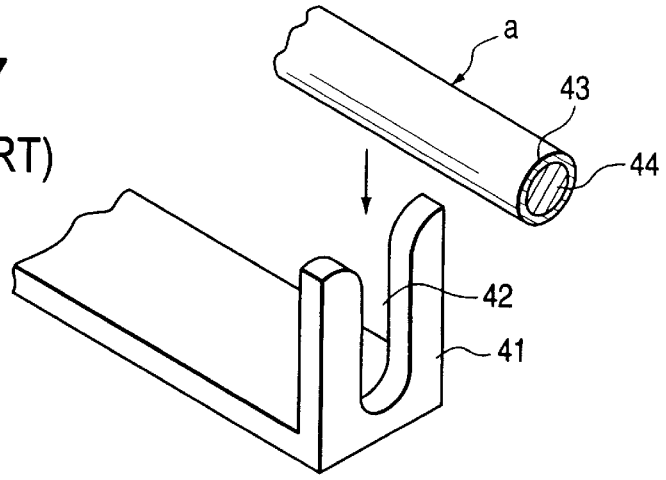
FIG. 7 (RELATED ART)
FIG. 7 is a perspective view showing a state of crimp connection.

As shown in FIG. 2, there is provided a servo motor 11 on an upper surface of the housing 10 of this crimp connecting press 1. This servo motor 11 holds a screw shaft 12*a* of the connecting rod 12 by means of a ball screw structure. Therefore, when the ball guide nut of the ball screw structure is turned, the screw shaft 12*a* (connecting rod 12) can be elevated. As shown in FIG. 3, a lower end portion of this connecting rod 12 is formed into a hook-shape. This hook-shaped portion is engaged with an upper end hook portion 14*a* of the elevating rod 14 of the crimp connecting blade 13. Due to the above arrangement, when the connecting rod 12 is elevated, the crimp connecting blade 13 can be also elevated.

As shown in FIG. 2, there are four elevating rods 14 of the crimp connecting blades 13 around a disk 15 integrated with the housing 10. The upper end hook portions 14*a* of the elevating rods 14 are engaged with a circumferential edge of the disk 15, so that the elevating rods 14 can be slidably supported. In this case, the number of the crimp connecting blades may be arbitrarily determined. There are provided guides 16 on both sides of each elevating rod 14. The elevating rod 14 is elevated between the guides 16. Each guide 16 is fixed to a rotary cylinder (not shown) rotatably arranged on a lower surface of the disk 15. When this rotary cylinder is rotated by a rotary actuator 17 on the disk 15, an arbitrary crimp connecting blade 13 is set at the crimp connecting position. At this time, the lower end hook portion of the connecting rod 12 fills a cutout portion of the disk 15 located at a crimp connecting position. Therefore, the elevating rod 14 can be moved without causing any problem. It is possible to use a pulse motor instead of the rotary actuator 17.

In the same manner as that of the elevating rod 14 of the crimp connecting press 1, the pallet P is moved when a screw shaft of a ball screw to which the pallet P is fixed is driven by a servo motor. This ball screw and servo motor are located under the pallet P and not illustrated in FIGS. 1 and 2 because they are hidden by the pallet P. However, the principle of the driving mechanism is the same as that of the elevating rod 14 of the crimp connecting press 1 described before. Accordingly, the detailed illustration and explanation are omitted here.

Figure 8:
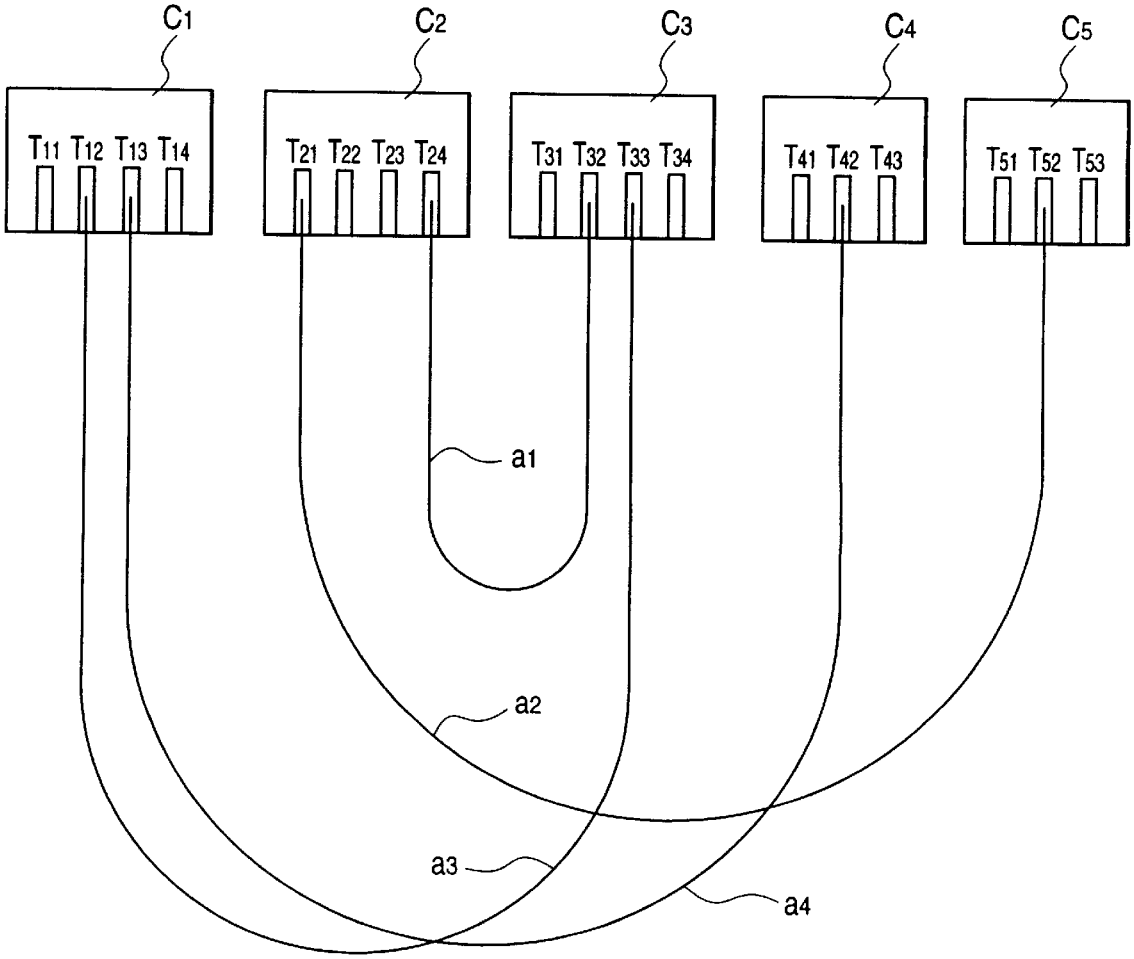
FIG. 8 is a plan view showing an exemplary model of the wire harness of complicated wiring structure.

A method of manufacturing a wire harness of this embodiment, in which the above apparatus is used, will be explained as follows. The wire harness explained in the conventional example shown in FIG. 8 is taken up here as an example of the wire harness to be manufactured. As described before, there are provided five connectors $C_1$, $C_2$, $C_3$, $C_4$ and $C_5$, which will be referred to as connectors C hereinafter. Connector $C_1$ has four terminals of $T_{11}$ to $T_{14}$, connector $C_2$ has four terminals of $T_{21}$ to $T_{24}$, and connector $C_3$ has four terminals of $T_{31}$ to $T_{34}$. In this case, the terminal numbers are put on the terminals from the left of the drawing. Connector $C_4$ has three terminals of $T_{41}$ to $T_{43}$, and connector $C_5$ has three terminals of $T_{51}$ to $T_{53}$. Electric wire "a" includes four electric wires of $a_1$, $a_2$, $a_3$ and $a_4$. In this case, both ends of each electric wire "a" are connected to the crimp connecting terminal T by means of crimp connection. In FIGS. 4 and 5 which will be referred in the explanations of manufacturing process, in order to avoid the complication of the drawings, only the terminal numbers used in the explanations are shown in the drawings.

First, the aforementioned five connectors C are put on the pallets P being aligned in a line. Of course, this work to put the connectors C on the pallets P can be automatized. However, for the purpose of reducing the overall size of the apparatus, this work is manually executed by a worker in this embodiment.

Next, the pallet P is moved by the servo motor via the ball screw, and the second crimp connecting terminal $T_{32}$ of the connector $C_3$ is made to come to a crimp connecting position X which is immediately below the crimp connecting blade 13 of the crimp connecting press 1. At this time, an amount of rotation of the servo motor to drive the pallet P is digitally controlled so that the movement of the pallet P can be optimized.

Then, as shown in FIG. 4(*a*), one end of the electric wire $a_1$ is manually fed to a groove of the crimp connecting terminal $T_{32}$ that has come to the crimp connecting position X. Of course, this electric wire $a_1$ can be automatized. However, for the same reason as that of the work in which the connector C is put on the pallet P, this work is manually executed in this embodiment for preventing the size of the apparatus from increasing.

Next, one end of the electric wire $a_1$ is connected to the connector C by means of crimp connection by the crimp connecting press 1. At this time, the servo motor 11 is operated, so that the crimp connecting blade 13 is lowered, and the electric wire $a_1$ in the groove of the crimp connecting terminal $T_{32}$ is pushed down, so that the electric wire $a_1$ can be connected to the connector with pressure. In this case, in the same manner as that of the movement of the pallet P, an amount of rotation of the servo motor 11 of the crimp connecting press 1 is digitally controlled, so that a pushing distance of the electric wire $a_1$ can be optimized. In this case, torque and rotating speed are also controlled, so that the pushing force and the pushing speed can be optimized. In this connection, in order to prevent the complication of drawings, reference numerals $C_1$, $C_2$, $C_3$, $C_4$ and $C_5$ of the connector are omitted in FIGS. 4(*b*) to 4(*d*) and FIGS. 5(*a*) to 5(*d*) described later. In the drawings, the connectors $C_1$, $C_2$, $C_3$, $C_4$ and $C_5$ are aligned from the left of the pallet P.

After the crimp connection of one end of the electric wire $a_1$ has been completed, the pallet P is moved again. As shown in FIG. 4(*b*), the crimp connecting terminal $T_{24}$ of the connector $C_2$ to which the other end of the electric wire $a_1$ is connected by means of crimp connection is moved to the crimp connecting position X, and the other end of the electric wire $a_1$ is manually fed to this position by a worker, and this portion is subjected to crimp connection by the press 1.

Next, in order to connect the electric wire $a_2$ with pressure by means of crimp connection, the pallet P is moved so that the crimp connecting terminal $T_{52}$ of the connector $C_5$, to which the electric wire $a_2$ is connected by means of crimp connection, can come to the crimp connecting position X. As shown in FIG. 4(*c*), when the crimp connecting terminal $T_{52}$ has come to the crimp connecting position X, one end of the electric wire $a_2$ is fed into the groove of the crimp connecting terminal $T_{52}$, and the crimp connecting terminal is connected by means of crimp connection by the crimp connecting press 1.

Next, the pallet P is moved so that the crimp connecting terminal $T_{21}$ of the connector $C_2$, to which the other end of the electric wire $a_2$ is connected by means of crimp connection, can come to the crimp connecting position X. As shown in FIG. 4(*d*), when the crimp connecting terminal $T_{21}$ has come to the crimp connecting position X, the other end of the electric wire $a_2$ is fed into the groove of the crimp connecting terminal $T_{21}$, and the crimp connecting terminal is connected by the press 1 by means of crimp connection.

Next, in order to connect the electric wire $a_3$ by means of crimp connection, the pallet P is moved so that the crimp connecting terminal $T_{12}$ of the connector $C_1$, to which the electric wire $a_3$ is connected by means of crimp connection, can come to the crimp connecting position X. As shown in FIG. 5(*a*), when the crimp connecting terminal $T_{12}$ has come to the crimp connecting position X, one end of the electric wire $a_3$ is fed into the groove of the crimp connecting terminal $T_{12}$, and the crimp connecting terminal is connected with pressure by the press 1 by means of crimp connection.

Next, as shown in FIG. 5(*d*), the pallet P is moved so that the crimp connecting terminal $T_{33}$ of the connector $C_3$, to which the other end of the electric wire $a_3$ is connected by means of crimp connection, can come to the crimp connecting position X. When the crimp connecting terminal $T_{33}$ has come to the crimp connecting position X, the other end of the electric wire $a_3$ is fed into the groove of the crimp connecting terminal $T_{33}$, and the crimp connecting terminal is connected by the press 1 by means of crimp connection.

Finally, in the same manner as that described before, the movement of the pallet P, the feed of the electric wire $a_4$ and the crimp connection by the crimp connecting press 1 are repeated, so that both ends of the electric wire $a_4$ are respectively connected by means of crimp connection to the terminal $T_{13}$ of the connector $C_1$ and the terminal $T_{42}$ of the connector $C_4$. In this way, wiring (crimp connection) of all electric wires "a" for the connectors C is completed, and the predetermined wire harness W can be provided.

In the case where it becomes necessary to replace the crimp connecting blade 13 because the size (outer diameter) of the electric wire "a" is different and accordingly the size (width and depth) of the groove of the crimp connecting terminal T is different, the rotary actuator 17 is driven, and a predetermined crimp connecting blade 13, which has been previously prepared, is set at the crimp connecting position X, so that the crimp connecting work can be continued. The unit of this electric wire "a" is not limited to one piece of electric wire, but the unit of this electric wire "a" may be a flat cable in which a plurality of element wires are arranged in parallel with each other and formed into a plane using a tape. When the above flat cable is used, crimp connection is conducted on the plurality of grooves of the flat cable all at once.

As explained above, the present invention can provide the following effects. When a wire harness of complicated wiring structure is manufactured, the size of the manufacturing apparatus can be reduced, and it is possible to produce various types of products, the quantity of which is small, at low cost.

What is claimed is:

1. A method of manufacturing a unit wire harness for an automobile comprising the steps of:

arranging a predetermined number of connectors necessary for the unit wire harness on a movable pallet;

moving the pallet so that a first crimp terminal of one of the connectors comes to a crimp connecting position of a rotatable crimp connecting press;

locating a first end of an electric wire at the first crimp terminal that has come to the crimp connecting position;

crimping the first end of the electric wire by the rotatable crimp connecting press; subsequently moving the pallet again so that a second crimp terminal of a predetermined connector comes to the crimp connecting position of the rotatable crimp connecting press;

locating a second end of the electric wire at the second crimp terminal that has come to the crimp connecting position;

crimping the second end of the electric wire so as to be connected to the second crimp terminal; and repeating the moving, locating and crimping steps as necessary until all connectors necessary for the unit wire harness are connected to the electric wires by crimp connections.

2. The method of manufacturing a unit wire harness for an automobile according to claim 1, wherein the movement of the pallet is numerically controlled.

3. The method of manufacturing a unit wire harness for an automobile according to claim 1, wherein the movement of a crimp connecting blade of the rotatable crimp connecting press is numerically controlled.

4. The method of manufacturing a unit wire harness for an automobile according to claim 3, wherein the crimp connecting press has a function of automatically replacing the rotatable crimp connecting blade.

5. The method of manufacturing a unit wire harness for an automobile according to claim 1, wherein the moving of the pallet comprises moving the pallet along rails on a surface of a frame on which the rotatable crimp connecting press is arranged.

6. The method of manufacturing a unit wire harness for an automobile according to claim 1, wherein the rotatable crimp connecting press includes a plurality of crimp connecting blades accommodating different wire sizes and crimp terminal sizes, and wherein the method further comprises the rotatable crimp connecting press automatically selecting the crimp connecting blade suitable for the wire size and crimp terminal size.

7. The method of manufacturing a unit wire harness for an automobile according to claim 6, wherein the selecting comprises rotating the rotatable crimp connecting press to locate the selected crimp connecting blade at the crimp connecting position.

8. The method of manufacturing a unit wire harness for an automobile according to claim 4, wherein the automatic replacement of the crimp connecting blade comprises rotating the rotatable crimp connecting press to locate a different crimp connecting blade at the crimp connecting position.

* * * * *